United States Patent [19]

May et al.

[11] 4,302,116

[45] Nov. 24, 1981

[54] PRINTING MACHINE WITH THROAT FOR FRONT LOADING OF SHEETS

[75] Inventors: Dean S. May, Georgetown, Tex.; James M. Rigotti, Rochester, Minn.

[73] Assignee: International Business Machines Corporation, Armonk, N.Y.

[21] Appl. No.: 108,980

[22] Filed: Jan. 2, 1980

Related U.S. Application Data

[63] Continuation-in-part of Ser. No. 937,624, Aug. 28, 1978, abandoned.

[51] Int. Cl.[3] ..... B41J 15/04

[52] U.S. Cl. ..... 400/124; 400/642; 400/639

[58] Field of Search ..... 101/93.22, 93.33; 400/642, 639, 636, 630, 632, 578, 328, 124, 122; 271/246

[56] References Cited

U.S. PATENT DOCUMENTS

| | | | |
|---|---|---|---|
| 1,675,969 | 7/1928 | Bull | 101/93.22 |
| 2,080,524 | 5/1937 | Allen | 400/639 X |
| 3,910,397 | 10/1975 | Harding | 400/122 |
| 4,024,942 | 5/1977 | Kawaji | 400/642 X |
| 4,030,726 | 6/1977 | Biedermann | 400/635 X |
| 4,053,040 | 10/1977 | McGourty | 400/124 X |
| 4,164,376 | 8/1979 | Yarp | 400/642 |

OTHER PUBLICATIONS

DiMarco et al., IBM Tech. Discl. Bulletin, vol. 21, No. 1, Jun. 1978, p. 238.

*Primary Examiner*—Edward M. Coven
*Attorney, Agent, or Firm*—J. Michael Anglin; Keith T. Bleuer

[57] ABSTRACT

A printing machine comprising a flat, substantially horizontal, guide portion on which the document to be printed is initially placed, a curved guide portion connected with the horizontal guide portion across which the document may be pushed manually and a final vertical guide portion connected with the curved guide portion providing a vertical passage across which a print head traverses for the purpose of printing on the document as it moves upwardly through the vertical passage. Drive rolls are provided in the vertical passage just above the line of traverse of the head for first continuously pulling the document upwardly through the passage once it has been manually pushed to this point and then incrementing the document upwardly through the machine and in the vertical passage for each of the lines of print provided by the print head.

5 Claims, 3 Drawing Figures

PRINTING MACHINE WITH THROAT FOR FRONT LOADING OF SHEETS

This application constitutes a continuation in part of our application, Ser. No. 937,624, filed Aug. 28, 1978 for "Printing Apparatus", now abandoned.

CROSS REFERENCE TO RELATED APPLICATION

This application is related to the application of T. H. Anderson et al., Ser. No. 948,860 filed Oct. 5, 1978 for "Shared Document Feed Station".

BACKGROUND OF THE INVENTION

The invention relates to printing machines and more particularly to machines for printing such documents as rectangular sales slips.

Prior conventional printing apparatuses for sales slips, which have been generally incorporated in cash registers or points of sale terminals, have generally been of the vertical slot type or flat bed type. In the vertical slot type, the document must be inserted in the side or top of the machine, an operation that is relatively inconvenient and awkward for an operator to perform. If small sales slips or other articles accidentally drop to the bottom of the slot, they are not retrievable by the operator, causing substantial trouble. Pressure rollers are provided for incrementing the document in its printing slot, and these generally must be lifted either by a magnet or manually to insert the document. Generally also, there is a limitation on paper size with the vertical slot type of printing apparatus.

With the flat bed type of printing apparatus, printing is sometimes reversed as the sales slip exits the machine and must be turned upside down to be read. The number of lines of print are generally limited with this type of printing apparatus, and the lines of print are not visible to the operator substantially at the same time as they are printed so that errors are not readily apparent.

SUMMARY OF THE INVENTION

It is an object of the present invention to provide an improved printing apparatus in which the document to be printed is placed by the operator in a substantially horizontal disposition initially and exits the machine in a substantially vertical disposition to be readily available to the operator.

It is also an object of the invention to provide an improved printing apparatus in which the lines of print provided by a print head are visible to the operator just after being made so that errors may be readily ascertained.

The improved printing apparatus of the invention in a preferred form includes a guide having an initial flat substantially horizontal portion on which the document to be printed may be initially placed, a final vertical portion providing a vertical passage from which the document exits after printing and in which a print head prints the lines of print on the document and an intermediate curved portion which bends the document as it is pushed into the machine. The machine on its top includes an opening providing a line of sight for the operator so that he can examine each of the lines of print just after it has been made by the print head of the apparatus. Pressure and drive rolls extend into the vertical passage for the document and are effective on the document to be printed as it travels vertically upwardly on the final portion of the guide. The drive rolls are controlled initially so that they continuously rotate to move the document in a continuous motion until the line for the first print line is reached, and then the rolls are incrementally rotated so as to increment the document past the print head. The print head is controlled so as to accomplish its printing by traversing across the print line between increments of the document. A keyboard may be located just below and in front of the initial substantially horizontal guide portion, and thus the keyed entry as printed may be inspected by the operator located at the front of the machine at the keyboard.

DESCRIPTION OF THE PREFERRED EMBODIMENT

Figure 1:
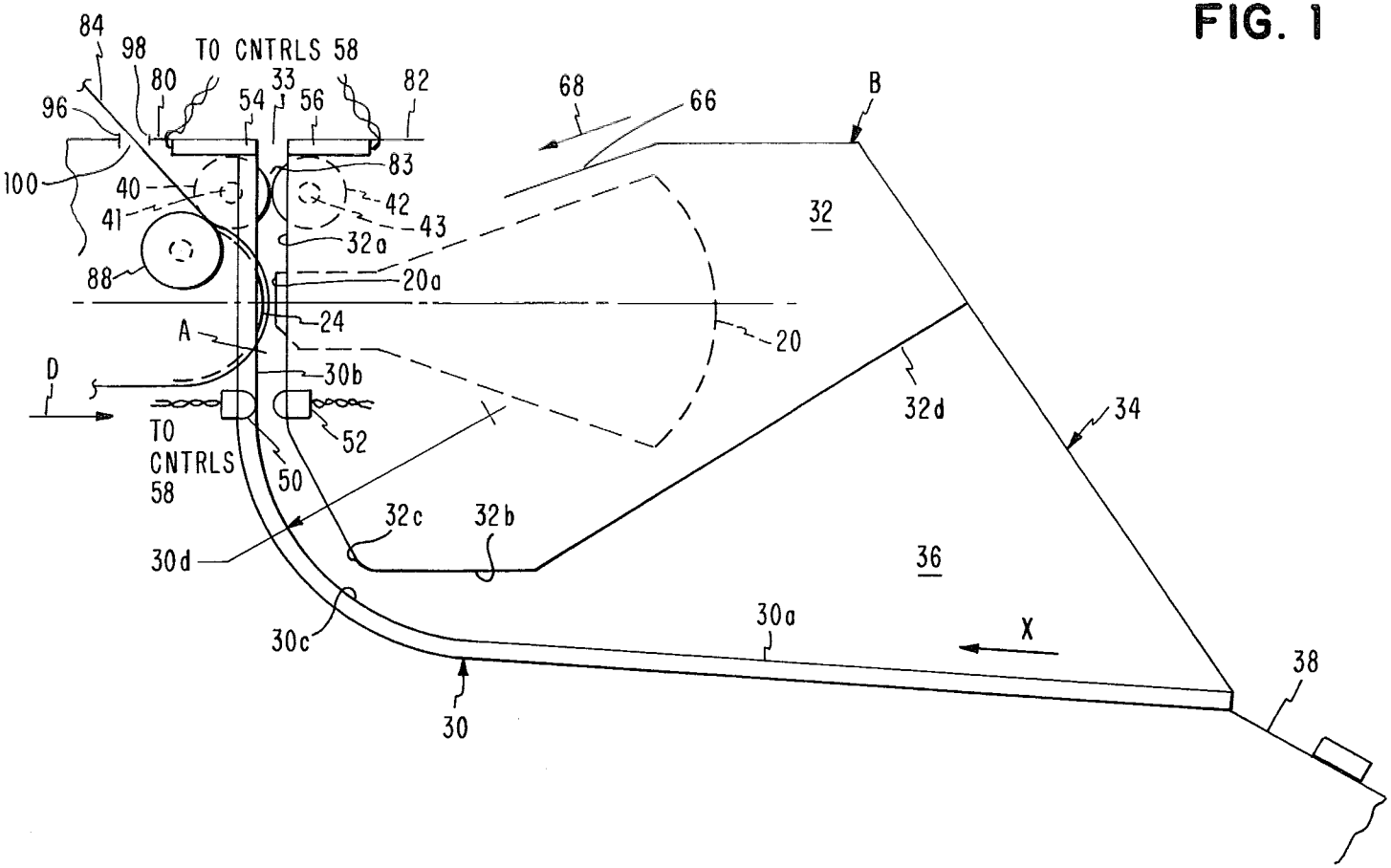
FIG. 1 is a fragmentary side elevational view of the printing machine of the invention.

The printing machine comprises a print head 20 which may be reciprocated on a center line 22 by any suitable propelling mechanism. The print head 20 may be of the wire printer type, for example; and it is disposed opposite a platen 24 for printing an elongate rectangular sales slip or other document 26 resting upon the platen 24. The platen 24 may be a cylinder or part of a cylinder with its cylindrical surface adjacent to and opposite the nose 20*a* of the print head 20. The print wires of the print head 20 are substantially horizontal and are directed in their motion out of the nose 20*a* and toward the center of the cylinder. The document 26 may be of quite thin paper stock or may be of relatively thick paper stock or may consist of a multipart form. The motion of the print head 20 on the center line 22 may be sensed by any suitable sensing means, such as a sensor 28.

Figure 2:
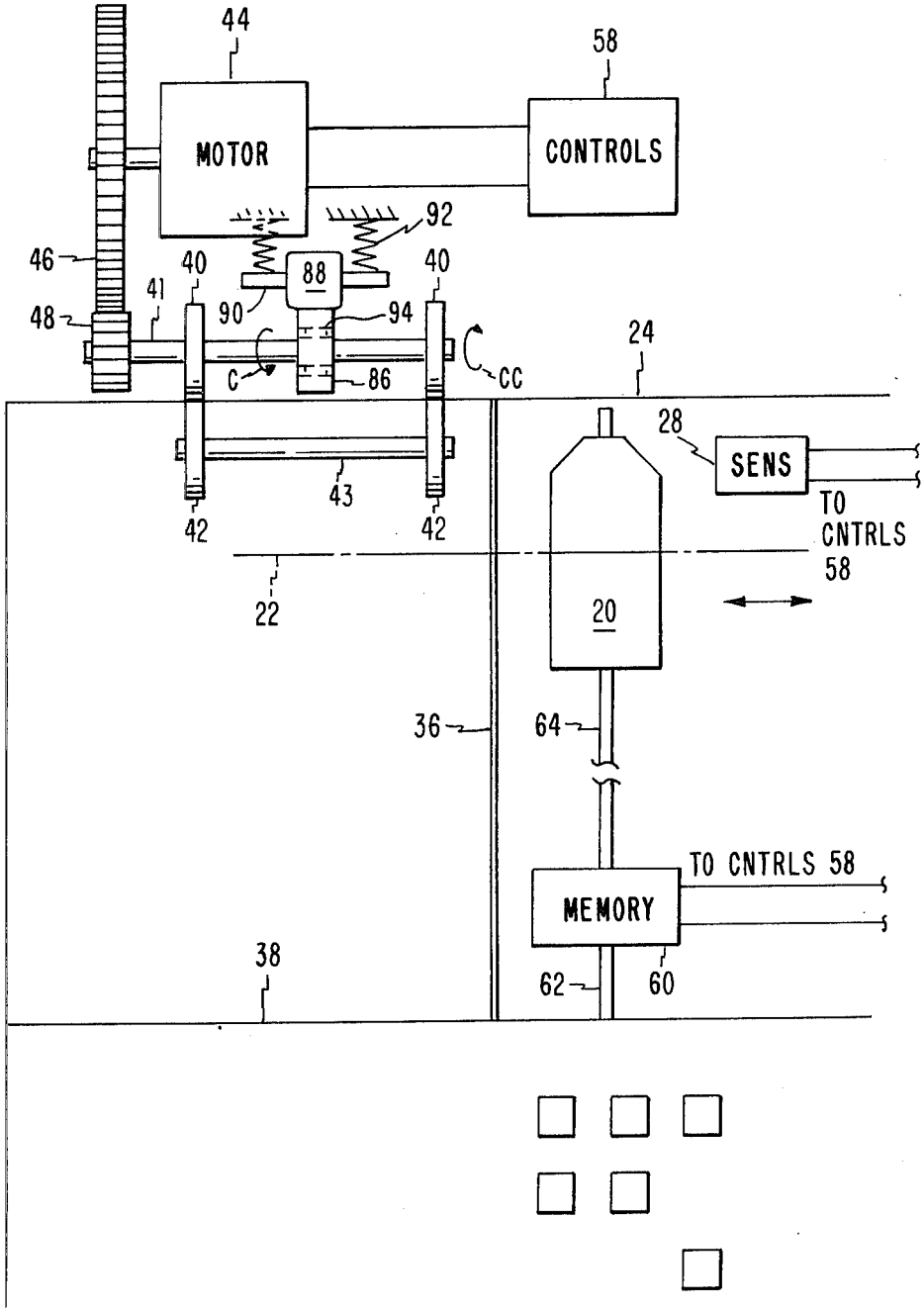
FIG. 2 is a fragmentary plan view, partially schematic, of the printing machine.
Figure 3:
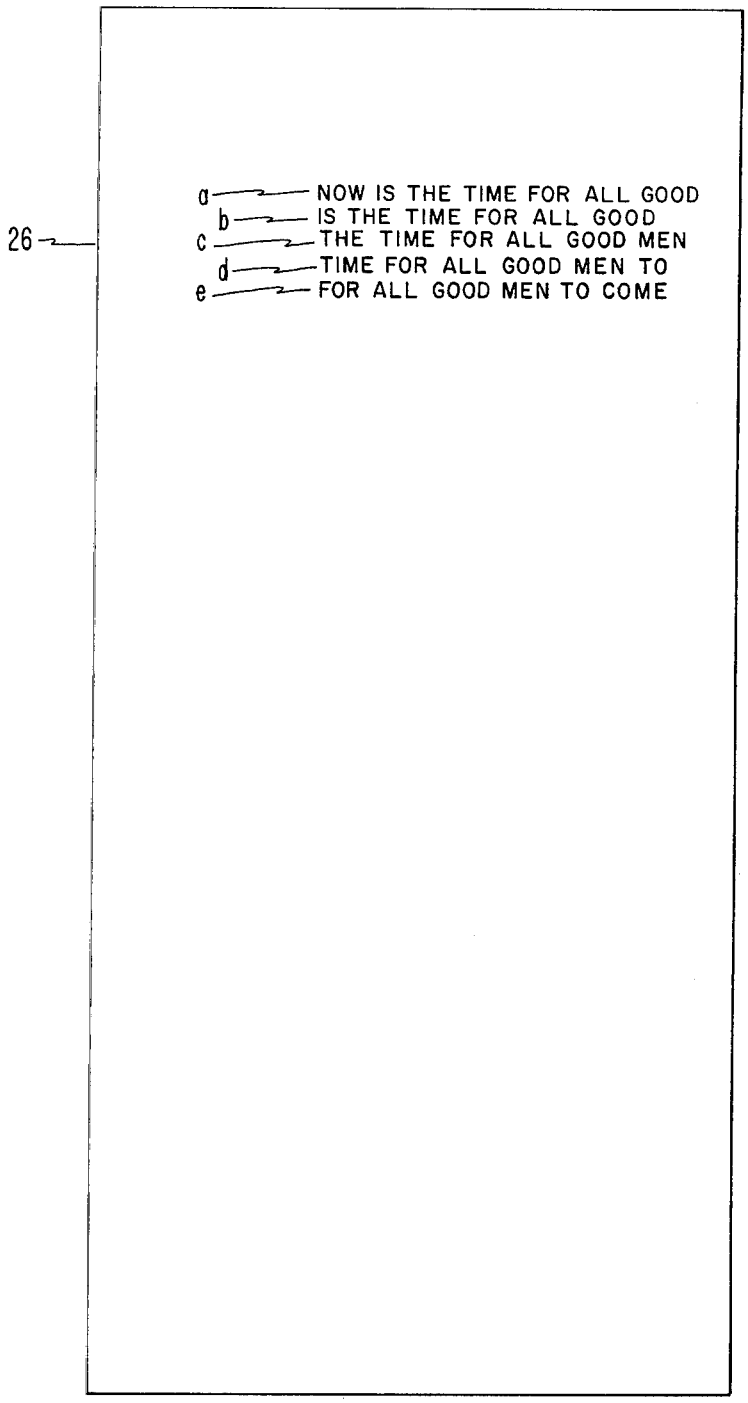
FIG. 3 is a plan view of a document which may be printed by the printing machine.

The machine comprises a lower guide 30 providing a nearly horizontal (slightly inclined in direction X) flat guide plate portion 30*a*, a vertical flat guide portion 30*b* and a curved guide portion 30*c* formed on a radius 30*d* connecting the guide portions 30*a* and 30*b* and extending for about 90 degrees. The machine also comprises an inner guide 32 which has a vertical surface 32*a* extending parallel with the guide portion 30*b* to provide a vertical passage A between these two surfaces, a horizontal guide surface 32*b* and a guide surface 32*c* extending upwardly at an angle with respect to the surface 32*b* , with the surfaces 32*b* and 32*c* being disposed opposite the curved portion 30*a* of the lower guide 30. The upper end of the passage A and the upper ends of the surfaces 30*b* and 32*a* are at the upper surfaces 80 and 82 of the printing machine casing B as is apparent from FIG. 1, and passage A has a document exit opening 33 between the casing surfaces 80 and 82. The guide 32 also has a surface 32*d* extending upwardly and at an acute angle with respect to the guide portion 30*a* so as to provide a document receiving throat 34. An aligning rail 36 for the document 26 forms one end of the throat 34 and acts to guide the document 26 into the apparatus. A keyboard 38 is provided in front of and below the aligning rail 36 and horizontal guide portion 30*a* as shown in FIGS. 1 and 2.

A pair of document drive rolls 40 disposed on a shaft 41 and an opposite pair of pressure rolls 42 disposed on a shaft 43 extend into the passage A, between the guide portion 30*b* and the vertical surface 32*a*. The rolls 40 and 42 are located beneath the upper surfaces 80 and 82 of the casing B of the printing machine and just as close as possible to the platen 24 and print head 20 in its traverse. In particular, the rolls 42 are positioned about the print head 20 as it traverses, and the rolls 40 are positioned above the platen 24, as shown in FIG. 1. The pressure rolls 42 are held in forceful but yieldable nipped relationship with the drive rolls 40 by any suitable means and provide the roll nip 83 in the passage A. The drive rolls 40 are propelled from a motor 44, which is preferably of the electrical stepping type, through spur gears 46 and 48.

The printing machine also accommodates a continuous length 84 of paper web drawn off of a suitable roll (not shown) and passing in direction D over the platen 24. The web passes between a web drive roll 86 disposed on the shaft 41 and a pressure roll 88 disposed on a shaft 90. Springs 92 are provided for forcing the shaft 90 toward the shaft 41 and thus holding the pressure roll 88 in forceful engagement with the drive roll 86 for thereby gripping the web 84 between them. A one-way clutch 94 is disposed between the shaft 41 and the drive roll 86 so that, when the motor 44 is effective for driving the shaft 41 in the clockwise direction C, the clutch 94 engages so as to drive the roll 86 for pulling the paper web 84 around the platen 24 in direction D and so that, when the shaft 41 is driven by the motor 44 in the counterclockwise direction CC, the clutch 94 disengages and allows the rolls 40 and 42 to be effective for pulling a document 26 upwardly in the passage A and over the platen 24. Serrated web cutting blades 96 and 98 are disposed on the opposite sides of a slot 100 in the upper surface 80 of the printing machine for accommodating the web 84, with the web 84 passing through the slot 100 and being severable by the blades 96 and 98.

A pair of document sensors 50 and 52 are disposed at the bottom of the vertical passage A, and a pair of sensors 54 and 56 are disposed at the upper end of the passage A. The motor 44 is under the control of controls 58; and controls 58 are under the control of sensors 28, 50, 52, 54 and 56.

The keyboard 38 is connected to a memory 60 of any suitable type as by means of data transferring bus 62. Memory 60 is also connected to the print head 20 as by means of data transferring bus 64 and has control connections with controls 58.

In order to print the document 26, it is placed on the horizontal portion 30*a* of the lower guide 30 in a substantially horizontal diposition. The document is then manually pushed in direction X so that its forward end contacts the curved guide portion 30*c*, and the document is thus bent against whatever inherent resilience the document material may have and moves upwardly in the passage A. The forward end of the document 26 when it passes between the sensors 50 and 52 causes the controls 58 to so operate on the motor 44 so that the motor drives the shaft 41 in the counterclockwise CC direction to drive rolls 40 and 42 at a continuous speed in a direction effective to feed the sales slip 26 upwardly in passage A when the sales slip is in the roll nip 83.

As the document 26 is moved farther upwardly in the passage A under manual force, its forward end eventually enters the nip 83 between the rolls 40 and 42; and these rolls then pull the document at a uniform speed upwardly in the passage A. When the forward end of the document passes between the sensors 54 and 56, these so operate on the controls 58 so that the motor 44 is then caused to incrementally rotate the rolls 40 in the same direction as previously; and the document incrementally moves upwardly in the passage A. The print head 20 under the control of controls 58 traverses across the document 26 for each of the increments of rotation of the rolls 40 and prints a line of print, such as the print line a, for the increment of rotation of the rolls 40. This printing occurs in the vertical passage A and on the platen 24 which supports the document during printing. The sensor 28 connected with the controls 58 assures that the motor 44 cannot be effective to provide another increment of rotation of the rolls 40 until a print line has been completed. Succeeding lines of print, such as lines b, c, d, etc., are printed on successive increments of rotation of the rolls 40.

The controls 58 may also be under the control of the keyboard 38 so that a reciprocation of the print head 20 does not take place until a line of print has been put into memory 60 by means of keyboard 38. In this case, the line of print a is first keyed into the keyboard 38 and is put into memory 60. The print head 20 then traverses across the document 26 and prints the first line a. The drive rolls 40 are then effective to move the document 26 upwardly in the passage A for an additional increment; the keyboard 38 than has its second line of print entered into it and thereby into memory 60; and the print head 20 is then reciprocated and prints the second line of print b on the document 26. Subsequently, the document 26 is incrementally moved upwardly in the passage A; and the succeeding lines of print c, d, e, etc., are printed by the print head 20 as it traverses across the document 26.

The machine casing B is provided with an opening 66 in its top so that there may be a line of sight 68 toward the platen 24 and below rolls 42. Thus, as each subsequent line is printed, the operator may check the accuracy of the printed line by viewing along the line of sight 68.

The printing of the web 84, as an alternative to printing the document 26, occurs when the controls 58 are so manipulated that the motor 44 causes the shaft 41 to be driven in the direction C. The controls 58 are so effective that the roll 86 is incremented, with the clutch 94 engaged, so that the web 94 is pulled over the platen 24 incrementally. Between each of the incremental movements of the web 84, the print head 20 is effective to print a line of print on the web 84 similarly to the printing action on the document 26. A document 26 is at this time not within the printing machine so that the print head 20 is effective on the web 84 rather than on a document 26. The apparatus for printing on the web 84 and the operation of the clutch 94 and associated mechanism are described in greater detail in the above mentioned Anderson et al. application, Ser. No. 948,860, filed Oct. 5, 1978.

Advantageously, the printing machine allows the operator to lay the document 26 on a flat, substantially horizontal, bed (guide portion 30*a*) and to push it away from him into the machine, which is very natural from the operator's standpoint. The operator places the document 26 in contact with the aligning rail 36, which is on the right side of the line of movement of the document 26, into the apparatus; and the document 26 is thus registered in its proper line of movement. The document 26 is pushed straight in toward the back of the machine with a slight pressure sideways, to the right as seen in FIG. 2, to maintain registration of the document.

The portion 30c of the lower guide 30 is formed on a generous radius (30d); and this may be, for example $1\frac{3}{4}$ inches (4.44 cm) to route the document 26 upwardly in passage A without any substantial manual force required in order to cause the document to bend through substantially 90° and without any permanent deformation or bend lines being provided in the document. The sensors 50 and 52 just above the radiused portion 30c of the guide 30 start the feed rolls 40 which need not be lifted or lowered to be effective; and once the document is under control of the feed rolls 40, the operator can relax his force to move the document upwardly through the vertical passage A. The document 26 is then automatically incremented through the printing transaction and is ejected out of the opening 33 at the top of the passage A and out of the top of the machine casing B to be readily available to the operator. Each of the lines of print as it is caused by the keyboard 38, for example, is readily visible, right side up, to the operator on the line of sight 68 as head 20 moves along the centerline 22 off of the line of print just printed, so that the operator can determine whether the line of print is without error. The printing on the lines a, b, c, d, e, etc., apears to the operator in the order in which the printing was keyed in from the keyboard 38 and can be immediately read as the document exits the machine. Since printing is done as the document is moved in a single direction through the machine, the document 26 may be of any reasonable length with a correspondingly great number of lines of print.

The rolls 40 and 42 are located to have their nip 83 in the passage A and above the platen 24 and print head 20 in its traversing motion for a number of reasons. The documents 26 are discrete documents as contrasted to the continuous web 84 and may be of rather flimsy material, although the machine is also effective if the documents 26 are relatively stiff. If a document 26 is of quite flimsy material, it is desirable to pull the document (using rolls 40 and 42) over the platen 24 and at the nose 20a of the print head 20 rather than pushing it, since the document otherwise during its incrementing movement could flex and crumple with defective printing by head 20. Also, it is desirable to have the shaft 42 on which the rolls 40 are mounted adjacent the upper surfaces 80 and 82 of the machine and above the platen 24, since the roll 86 driven by and on shaft 41 may in this case be used for moving the web 84. The web 84 may also be of rather flimsy material, and the roll 86 should therefore be located in a position to pull the web 84 over the platen 24 and close to the opening 100 through which the web 84 exits. The rolls 40 and 42 should be located as close as possible to the print head 80 and the platen 24, since the part of a document 26 between the nose 20a of the print head 80 and the nip 83 of the rolls 40 and 42 cannot be printed on and in this respect is wasted material. This is true, since the rolls 40 and 42 do the incrementing of documents 26 which is needed for printing. Obviously, it is desirable to have as much as possible of the complete length of a document 26 available for printing. For aesthetic reasons, the rolls 40 and 42 should be located beneath the upper surfaces 80 and 82 of the machine.

In the event that a document is accidentally dropped into the document exit slot (the vertical passage A) from the top of the machine, the document may be easily retrieved either by moving it upwardly out of the passage A or off of the substantially horizontal flat guide portion 30a if the document moves far enough and around the curved guide portion 30c. The guide portion 30a is located just above the keyboard 38, so the guide portion 30a is not only easily within reach for retrieval of documents but also is within easy reach for inserting documents into the machine for printing in the usual manner.

Having thus described the invention, what is claimed as new, and desired to be secured by Letters Patent is:

1. In an operator-controlled apparatus having a keyboard, a printing machine at least partially under control of said keyboard for printing transverse lines of print on an elongate discrete document inserted by said operator and including:

an outer document guide having an initial substantially horizontal flat guide portion adjacent said keyboard and a curved guide portion connected therewith and a final vertical guide portion connected with said curved guide portion, an inner document guide having a surface extending upwardly at an acute angle with respect to said initial guide portion for providing a document-receiving throat, and a vertical surface providing a vertical passage with said final vertical guide portion whereby the discrete document may be deposited on the initial guide portion and may be pushed by said operator into said throat and over the curved guide portion to said vertical passage through which the document may exit upwardly, a print head disposed to traverse said vertical passage for thereby printing lines of print on the document as it moves through said vertical passage, a platen having a cylindrical surface disposed in said vertical passage opposite said print head for supporting the document during the printing action of the print head, a pair of rolls located opposite each other one above said print head and the other above said platen and having a nip between them within said vertical passage for gripping the document and being located closely adjacent to said platen and said print head as the print head traverses, motor means for driving said rolls in such directions so that the rolls propel the document upwardly in said passage, and a printing machine casing having upper surfaces located above said rolls and providing a document exit opening of said vertical passage.

2. A printing machine as set forth in claim 1, said printing machine casing and said inner guide being provided with openings therethrough located below the one of said rolls that is above said printer and in the line of sight to said platen so that a line of print as printed by said print head as it crosses said platen is apparent after the print head has completed its traverse across this line of print.

3. A printing machine as set forth in claim 1 wherein said print head is disposed within said machine casing and in a position above said document-receiving throat.

4. A printing machine as set forth in claim 1 wherein said document receiving throat is disposed directly above and to the rear of said keyboard.

5. Printing mechanism as set forth in claim 1 and including sensor means located at the bottom end of said vertical passage and below said rolls for causing said motor means to continuously drive said rolls to propel said document upwardly in said passage when said document passes said sensor means and including second sensor means located in said passage above said rolls for causing said motor means to discontinue the continuous rotation of the rolls and to incrementally drive them when said document passes said second sensor means whereby the printer may be effective to traverse across said passage and print lines of print during increments of said document.

* * * * *